US005586016A

United States Patent [19]

Konopka et al.

[11] Patent Number: 5,586,016

[45] Date of Patent: Dec. 17, 1996

[54] CIRCUIT FOR QUICKLY ENERGIZING ELECTRONIC BALLAST

[75] Inventors: John G. Konopka, Barrington; Robert A. Priegnitz, Algonquin, both of Ill.

[73] Assignee: Motorola, Inc., Schaumburg, Ill.

[21] Appl. No.: 270,333

[22] Filed: Jul. 5, 1994

[51] Int. Cl.[6] ..... H05B 41/36

[52] U.S. Cl. ..... 363/21; 323/282

[58] Field of Search ..... 323/282, 344, 323/222; 363/17, 20, 21, 41, 58, 98, 101, 132, 16; 315/219, 247, 224, 307, DIG. 5, DIG. 7, 209 R, 291, 308, 248

[56] References Cited

U.S. PATENT DOCUMENTS 5,363,020 11/1994 Chen et al. ..... 315/209 R

*Primary Examiner*—Peter S. Wong

*Assistant Examiner*—Aditya Krishnan

*Attorney, Agent, or Firm*—J. Ray Wood

[57] ABSTRACT

An electronic ballast having a boot strap capacitor 22 that becomes initially charged at a first rate and a high voltage storage capacitor 23 that becomes charged at a second, faster rate, wherein the boot strap capacitor 22, becoming initially fully charged initiates operation of a PWM driver 18 that in turn causes a power factor corrector and inverter 16 to energize corresponding gas discharge lamps 11. Upon activation of the PWM driver 18 and the corresponding activation of the power factor corrector and inverter 16, a voltage clamp 19 responds to these events by establishing a conductive path 20 between the high voltage storage capacitor 23 and the boot strap capacitor 22, such that continued operation of the PWM driver 18 is ensured. So configured, a relatively small valued capacitor can be utilized for the boot strap capacitor 22, thereby ensuring rapid activation of the lamps 11 without risking subsequent sporadic energization or other operational difficulties.

7 Claims, 2 Drawing Sheets

CIRCUIT FOR QUICKLY ENERGIZING ELECTRONIC BALLAST

The technical field of this invention relates generally to electronic ballasts used to energize gas discharge lamps.

BACKGROUND OF THE INVENTION

Gas discharge lamps are well known in the art. Typically, such lamps are energized by a ballast. Unlike incandescent lights, gas discharge lamps and their accompanying ballasts as found in the prior art do not switch on instantly. When turn on time becomes too long, users of the product may become confused when trying to switch the light on, and may conclude that the light or the ballast is no longer functioning properly.

An electronic ballast has a boost coupled to an inverter. The output of the inverter energizes the lamps. Before the lamps are fully energized, the boost and the inverter must begin to operate. This creates a delay which, if not controlled, is perceptible to the user.

Some electronic ballasts have a boost circuit. The boost circuit provides power factor correction, as is well known in the prior art. The boost is composed of a bridge rectifier coupled to an AC (alternating current) power source. The bridge rectifier supplies pulsating DC (direct current) power to a boost inductor. A pulse width modulator (PWM) driver drives a semiconductor switch, supplying energy to an electrolytic capacitor through a diode. The output of the boost is coupled to a load. A switch, when closed, connects the boost to the AC power source.

One problem that arises is with powering the pulse width modulator driver. The PWM driver is an integrated circuit, and thus will not begin operating until it is supplied with 10 volts DC (direct current). Since the circuit is coupled to a 60 Hz AC (alternating current) voltage source, there will be some amount of time elapsed before the 10 volt DC is supplied to the PWM driver. Until the PWM driver begins operating, reduced power is supplied to the load.

It is highly desirable to have the PWM driver begin operating as soon as possible after the switch is closed. At the same time, of course, the circuit powering the PWM driver must be low cost.

One known method for powering the PWM driver at start up uses current flowing through a resistor to charge a capacitor. The voltage on the capacitor increases until it reaches the turn-on threshold of PWM driver.

After startup, the PWM driver must have a source of higher power. The operation of the PWM driver causes the semiconductor switch to begin operating, causing high frequency current to flow through a boost inductor . The high frequency current is coupled to a secondary winding, rectified by a diode and supplied to a capacitor, thus sustaining the energy in the capacitor at a sufficient level to power the PWM driver. If the switch is a field effect transistor (FET), the total current drawn by the PWM driver and the FET semiconductor switch is approximately 20 milliamps. With a capacitor having a capacitance of 47 mF (microfarads), a startup time of about 0.5 seconds is achieved.

However, if a high voltage, on the order of 800 volts or more, is across the semiconductor switch, then an expensive, high voltage FET must be used. A bipolar junction transistor (BJT) would be more cost effective.

Using a BJT for the semiconductor switch presents an additional problem. Because a BJT requires much more drive current, the amount of current drawn by the PWM driver is much more (on the order of 200 milliamps, as compared to 20 milliamps for an FET).

To supply such a large current, the capacitor must also be larger (approximately ten times larger with a BJT as opposed to an FET). But, if the capacitor is ten times larger, in order to preserve the charging time of capacitor, the resistor must be 10 times smaller. But, if the resistor is ten times smaller, then the power dissipation by the resistor is ten times greater. Such a high power dissipation causes the ballast to become less efficient, since power is being wasted. Additionally, the heat generated by the dissipation in power may adversely effect the operation of the entire ballast.

Thus, a more efficient circuit for quickly energizing the PWM driver is highly desirable.

DETAILED DESCRIPTION OF THE PREFERRED EMBODIMENTS

Figure 1:
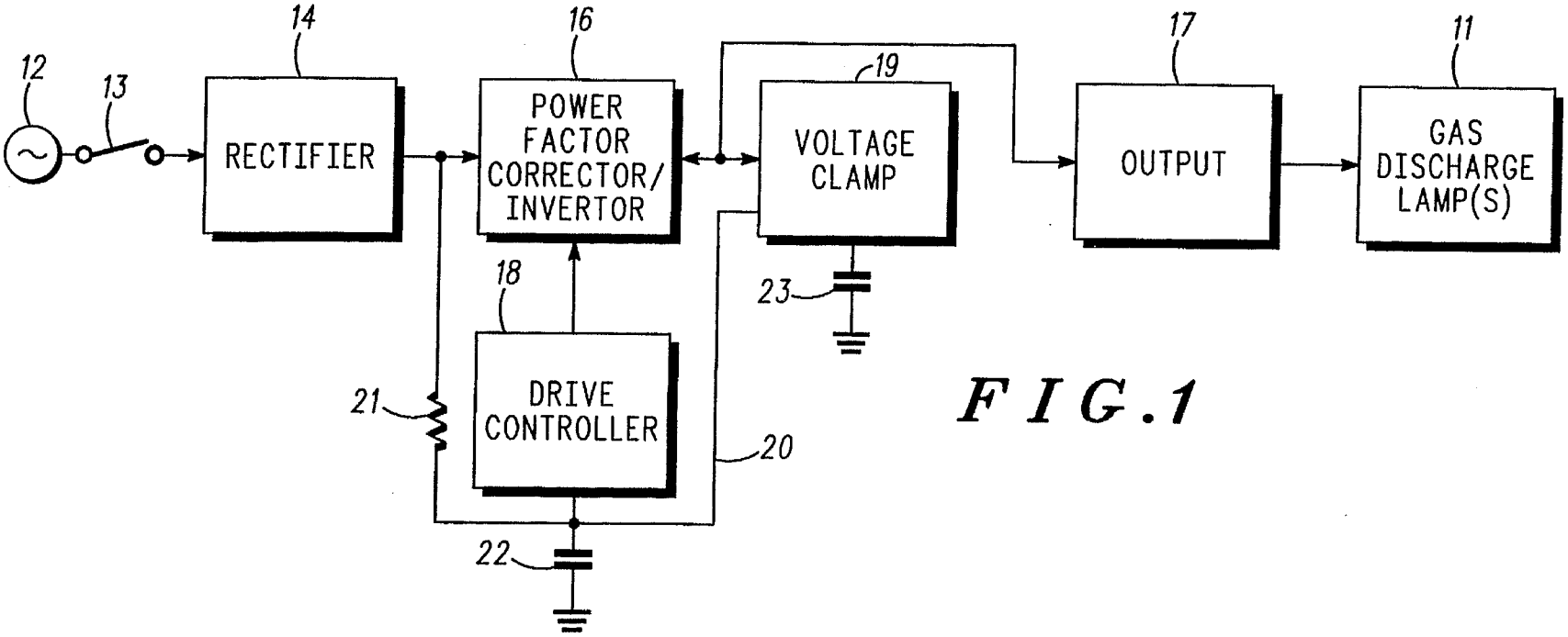
FIG. 1 comprises a block diagram depiction of an electronic ballast configured in accordance with the invention.

Referring now of FIG. 1, the electronic ballast described herein couples to a pair of series connected gas discharge lamps 11. (Although a pair is shown, one or more lamps may be connected in their stead.) The electronic ballast couples to a source of alternating current 12 through a user operable switch 13, as is well understood in the art. A rectifier 14 receives the alternating current and provides a full wave rectified output. This output couples to both a power factor corrector and inverter 16 and to a PWM driver 18 via a resistor 21 and a boot strap capacitor 22 (the boot strap capacitor 22 serves, amongst other things, to filter the rectified alternating current signal provided by the rectifier 14). The PWM driver 18 is coupled to and controls operability of the power factor corrector and inverter 16. A voltage clamp 19 couples to the power factor corrector and inverter 16 and also couples, via a conductive path 20, to the boot strap capacitor 22. Lastly, the power factor corrector and inverter 16 also couples to an output 17 which in turn couples to the gas discharge lamps 11.

So configured, the power factor corrector and inverter 16 provides the high voltage/high frequency signal that is needed to energize the gas discharge lamps 11. The PWM driver 18 controls operation of the power factor corrector and inverter.

The boot strap capacitor 22 has a corresponding charging rate (which charging rate is dependent upon a variety of factors, including the capacitance of the boot strap capacitor 22 itself). Similarly, the high voltage storage capacitor 23 has a corresponding charging rate in the context of the circuit depicted. Importantly, the charging rate for the boot strap capacitor 22 is slower than the charging rate for the high voltage storage capacitor 23. With this in mind, it will now be pointed out that, when the switch 13 is closed, a charging path exists between the rectifier 14 and the high voltage storage capacitor 23, as well as with the boot strap capacitor 22. So configured, once the switch 13 is closed, both capacitors 22 and 23 will begin to charge, with the high voltage storage capacitor 23 becoming completely charged first. In this embodiment, it is preferable that the high voltage storage capacitor have a charging rate that does not exceed 10 milliseconds, whereas the boot strap capacitor 22 should have a charging rate that does not exceed 500 milliseconds. Although other time periods could be utilized, longer timing rates may give rise to delay start times that are, in turn, interpreted by a user as indicative of failure.

The boot strap capacitor 22 must have a relatively low capacitance value in order to ensure that the charging rate for the boot strap capacitor 22 will not exceed 500 milliseconds. Therefore, although the boot strap capacitor 22 will charge relatively quickly, it will not contain a large quantity of stored energy. Once the boot strap capacitor 22 becomes charged, an energizing signal is provided to the PWM driver 18, which in turn initially activates the power factor corrector and inverter 16. When the power factor corrector and inverter 16 becomes active, a drive signal is provided to the gas discharge lamps 11.

At the same time, the voltage clamp 19 responds to operation of the power factor controller and inverter 16 by establishing a conductive path 20 that selectively couples the high voltage storage capacitor 23 to the boot strap capacitor 22, thereby delivering energy from the high voltage storage capacitor 23 to the boot strap capacitor 22 and hence sustaining continued operation of the PWM driver 18.

To summarize the above description, the boot strap capacitor 22 will charge relatively quickly (from the standpoint of an observer) and can provide sufficient energy to the PWM driver 18 to cause initial activation of the electronic ballast. .Its smaller size, ensures rapid initial activation. However, the boot strap capacitor 22 cannot long sustain operation of the PWM driver 18. Since, upon activation, a path 20 is formed between the two capacitors 22 and 23 through the voltage clamp 19, and since the high voltage storage capacitor 23 completed its full charge before the boot strap capacitor 22, energy from the high voltage storage capacitor 23 is thereafter made available to the boot strap capacitor 22 to sustain continued operation of the PWM driver 18 and hence continued energization of the gas discharge lamp 11.

Figure 2:
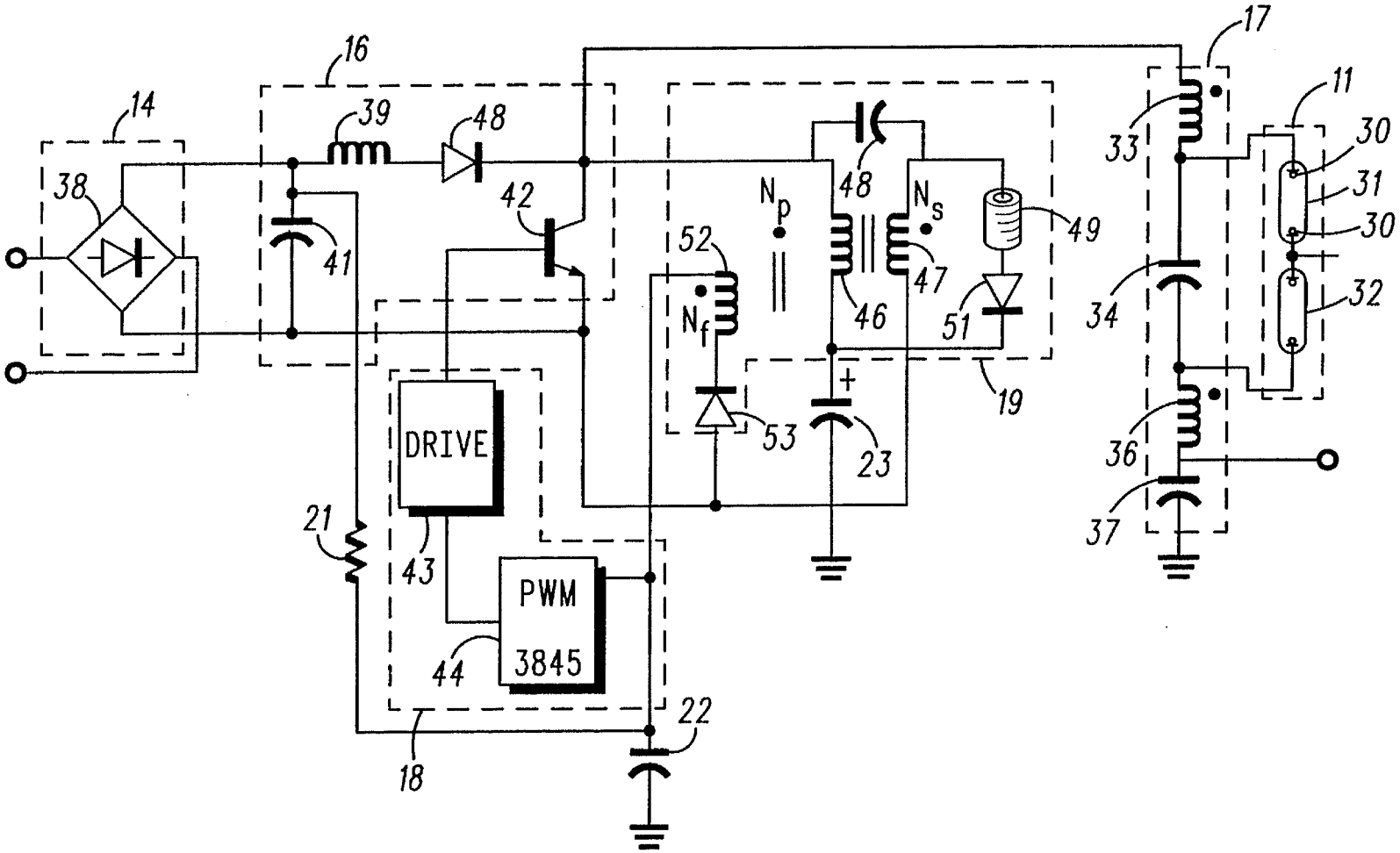
FIG. 2 comprises a schematic depiction of an electronic ballast as configured in accordance with the invention.

Referring now to FIG. 2, in more detailed description of an electronic ballast in accordance with the invention will be presented.

The rectifier 14 can be comprised of a diode bridge 38. The power factor corrector and inverter 16 includes a circuit comprised of a 6 mH (microhenry) inductor 39 and a 0.1 mF capacitor 41. The circuit couples to a diode 40 and a MJE18004 bipolar transistor 42. (As an aside, the power factor corrector and inverter 16 contains this transistor 42 as the only active lo component in its design). The PWM driver 18 includes a drive element 43 and a pulse width modulation control element 44, provided through use of an MC3845 integrated circuit, as is well understood in the art. The boot strap capacitor 22 in this embodiment comprises a 47 mF capacitor. Resistor 21 that couples the boot strap capacitor 22 to the rectifier comprises a 220,000 ohm resistor.

The voltage clamp comprises a transformer having a primary winding 46 and two secondary windings 47 and 52. A 0.1 mF capacitor 48 couples across the primary 46 and the first secondary 47. A ferrite bead 49 (for electromagnetic interference suppression) and a diode 51 are disposed as configured. The second secondary 52 couples to a diode 53 and to the path 20 to the boot strap capacitor 22 as described above.

In this embodiment, the high voltage storage capacitor 23 couples to the primary 46 and comprises a 22 mF capacitor.

So configured, energy from the high storage capacitor 23 is inductively coupled through the primary 46 and second secondary 52 via the path 20 to the boot strap capacitor 22 when the voltage clamp circuit 19 is rendered fully operational via the transistor 42 of the power factor corrector and inverter 16.

To conclude this more detailed description, the output 17 includes two inductors 33, 36 and two capacitors 34, 37 configured to form appropriate resonant circuits suited to properly maintained energization of the gas discharge lamp 11. The lamps 31 and 32 are themselves coupled into the electronic ballast circuitry via appropriate gas discharge lamp terminals 30, as well understood in the art.

So configured, a relatively simple and inexpensive circuit configuration provides for rapid activation of gas discharge lamps, with effective sustained operation of those lamps also being ensured.

We claim:

1. An electronic ballast for energizing a gas discharge lamp from a source of AC power, comprising:

A) a power factor converter and inverter;

B) a PWM driver that is operably coupled to the power factor converter and inverter;

C) an output, the output having gas discharge lamp terminals; the power factor corrector and inverter coupled to the output;

D) a first capacitor having a first charging rate and being coupled to both the PWM driver and the output, the first capacitor providing power to the PWM driver before the PWM driver begins operating;

E) a second capacitor having a second charging rate, which second charging rate is slower than the first charging rate, and being operably coupled to the PWM driver, the second capacitor providing power to the PWM driver after the PWM driver starts operating; and F) a path responsive to activation of the PWM driver for coupling the first capacitor to the second capacitor when the PWM driver is activated.

2. The electronic ballast of claim 1, wherein the power factor corrector and inverter includes a first transistor.

3. The electronic ballast of claim 2, wherein the power factor corrector and inverter includes only a single active device.

4. The electronic ballast of claim 1, and further comprising a voltage clamp operably coupled to the power factor corrector and inverter, the PWM driver, and the second capacitor, and which includes the path.

5. The electronic ballast of claim 1 wherein the first charging rate is no longer than 10 milliseconds.

6. The electronic ballast of claim 1 wherein the second charging rate is no longer than 500 milliseconds.

7. The electronic ballast of claim 1, wherein the path includes a transformer coupling.

* * * * *